US005458144A

United States Patent [19]

Lavine

[11] Patent Number: 5,458,144

[45] Date of Patent: Oct. 17, 1995

[54] EXTENDIBLE UMBRELLA HANDLE

[76] Inventor: Edward L. Lavine, 206 Allandale Rd., Chestnut Hill, Mass. 02167

[21] Appl. No.: 140,796

[22] Filed: Oct. 21, 1993

[51] Int. Cl.[6] ..... A45B 25/14

[52] U.S. Cl. ..... 135/24; 135/25.1; 135/25.41; 403/377; 362/399

[58] Field of Search ..... 135/25.4, 25.41, 135/76, 72; 280/823; 362/102, 109, 399; 403/348, 349, 377; 248/188.5

[56] References Cited

U.S. PATENT DOCUMENTS

| | | | |
|---|---|---|---|
| 1,007,572 | 10/1911 | Howe | 135/76 |
| 2,117,373 | 5/1938 | Sobotka | 135/76 |
| 2,820,655 | 1/1958 | Hileman | 403/349 |
| 3,281,586 | 10/1966 | Gonzalez | 362/102 |
| 3,496,950 | 2/1970 | Weber et al. . | |
| 3,678,949 | 7/1972 | Weber . | |
| 3,811,455 | 5/1974 | Thur . | |
| 3,851,657 | 12/1974 | Weber . | |
| 3,933,011 | 1/1976 | Di Gilio et al. | 403/349 X |
| 4,011,881 | 3/1977 | Becher . | |
| 4,518,162 | 5/1985 | Oates | 403/349 X |
| 4,685,482 | 8/1987 | Yung . | |
| 4,736,761 | 4/1988 | Warfield et al. . | |
| 4,744,013 | 5/1988 | Lee et al. | 362/109 |
| 4,763,679 | 8/1988 | Lerch . | |
| 4,858,633 | 8/1989 | Yang . | |
| 4,930,533 | 6/1990 | Allen | 135/25.4 |
| 4,977,913 | 12/1990 | Meyman . | |
| 5,016,148 | 5/1991 | Kohm | 362/109 X |
| 5,020,558 | 6/1991 | Huang . | |
| 5,060,684 | 10/1991 | Wu . | |
| 5,063,952 | 11/1991 | Seidel et al. . | |
| 5,080,118 | 1/1992 | Allen . | |
| 5,275,186 | 1/1994 | Liu | 135/25.4 X |

FOREIGN PATENT DOCUMENTS

| | | |
|---|---|---|
| 2115076 | 3/1971 | Germany . |
| 2151477A | 7/1985 | United Kingdom . |

*Primary Examiner*—Lanna Mai
*Attorney, Agent, or Firm*—Wolf, Greenfield & Sacks

[57] ABSTRACT

An extendible handle assembly for an umbrella includes an adapter for coupling to a shaft and a sleeve. The sleeve has a series of grooves, and the adapter has tabs which move within the grooves. The adapter and the shaft move axially relative to each other in order to extend the length of the handle. In another embodiment, the handle construction has an adapter, an inner sleeve, and a shell. The adapter and inner sleeve each have tabs which mate with grooves in the inner sleeve and the shell, respectively. The adapter may be rigidly coupled to the shaft with threads, or may have a switch operated opening mechanism.

20 Claims, 5 Drawing Sheets

EXTENDIBLE UMBRELLA HANDLE

FIELD OF THE INVENTION

This invention relates to an extendible handle assembly for a hand-held, hand-carried device, such as an umbrella.

BACKGROUND OF THE INVENTION

Current efforts to shorten the overall length of umbrellas for convenient carrying and storing have resulted in umbrellas in which the frame and shaft of the umbrella can be collapsed and extended as desired. These efforts have generally involved structures in which a unitary handle slides along the end of the umbrella shaft. The umbrella handle itself does not generally have a telescopic configuration or feature. For example, in Weber, U.S. Pat. No. 3,678,949, issued Jul. 25, 1972, an umbrella has a hollow open-ended handle at one end which is axially movable relative to the shaft, but which does not extend the effective length of the handle. Other examples of handles which are retractable include, for example, Weber, U.S. Pat. No. 3,851,657, issued Dec. 3, 1974.

Since compactness is desirable, some umbrellas have a very short handle which is difficult to hold. If the handle is made longer, the length of the umbrella increases.

SUMMARY OF THE INVENTION

A telescopic handle construction for an umbrella is described in my prior patent, U.S. Pat. No. 5,186,197, which is expressly incorporated by reference.

According to the present invention, a handle assembly is provided for a hand-carried object, such as an umbrella. The umbrella has a shaft which supports a collapsible frame and fabric of the umbrella at one end. A shaft adapter, which is secured to the other end of the shaft, is coaxially aligned with a sleeve. The adapter is coupled to the sleeve so that the adapter and sleeve can be axially moved relative to each other from a first position to a second position. The combined length of the sleeve and adapter is longer in the second position that in the first position.

The sleeve preferably has a number of grooves on the inside surface, and the adapter has an equal number of tabs which extend radially and mate with the grooves. The grooves may be straight or may have L-shaped bends for securing the adapter and the sleeve in an open position. The adapter and sleeve are preferably cylindrical or tubular in shape, but could also have a multi-sided or multi-curved cross-section, such as a square. The sleeve preferably has a closed end, while the adapter may or may not have a closed end.

In another embodiment, the handle assembly includes an adapter, an inner sleeve, and an outer sleeve. The adapter and the inner sleeve each have a number of radial tabs, and the inner sleeve and the outer sleeve each have an equal number of grooves on the interior surfaces. The interface between the adapter and the inner sleeve and the interface between the inner sleeve and the outer sleeve each have a tight frictional fit which retains the relative positions, but does not prevent a user from moving one relative to another. The adapter can be moved relative to the inner sleeve and/or the inner sleeve can be moved relative to the outer sleeve. Additional intermediate sleeves could also be added is desired to provide for further extending the length.

The invention also features a back end loaded method for making an extendible handle. The method includes the steps of providing an adapter for coupling to a shaft at a first end and a second end opposite the first end; providing a sleeve is coaxial with the adapter and has a first end facing the shaft and a second opposite end inserting the first end of the adapter into the second end of the sleeve; and providing a stop to prevent the adapter from being withdrawn from the second end of the sleeve. The stop can be provided as a cap bonded to the second end of the sleeve.

The shaft may be coupled to the adapter in one of a number of different ways. For example, the shaft may have a threaded end which is coupled to a threaded receptacle in the adapter. In the case of an umbrella, the adapter could include a switch, such as a push button, on the adapter for actuating an opening mechanism to open the umbrella. In this case, a sleeve may be provided around the adapter so that in a first position, the sleeve covers the switch, and in a second position, the switch is exposed for actuation. Other types of connections between the adapter and the sleeve can be used.

According to the present invention, an umbrella can be made in a compact form, and the handle can be adjusted to suit the desires of individual users. The handle is easily adjusted, and can retain its position until a user wants to change positions. The length of the handle from a closed position to an open position may be increased by up to about two times according to one exemplary embodiment. Although extended, the adapter and the one or more sleeves have a fit which does not allow the handle to wiggle between the telescoping pieces. Thus the umbrella can be made very compact, while still having a handle which is stable and easy to hold. With a push button mechanism, the sleeve also protects the button and prevents accidental opening.

BRIEF DESCRIPTION OF THE DRAWINGS

Other features and advantages will become apparent from the following detailed description and from the claims when read in conjunction with the drawings in which:

DETAILED DESCRIPTION

Figure 1:
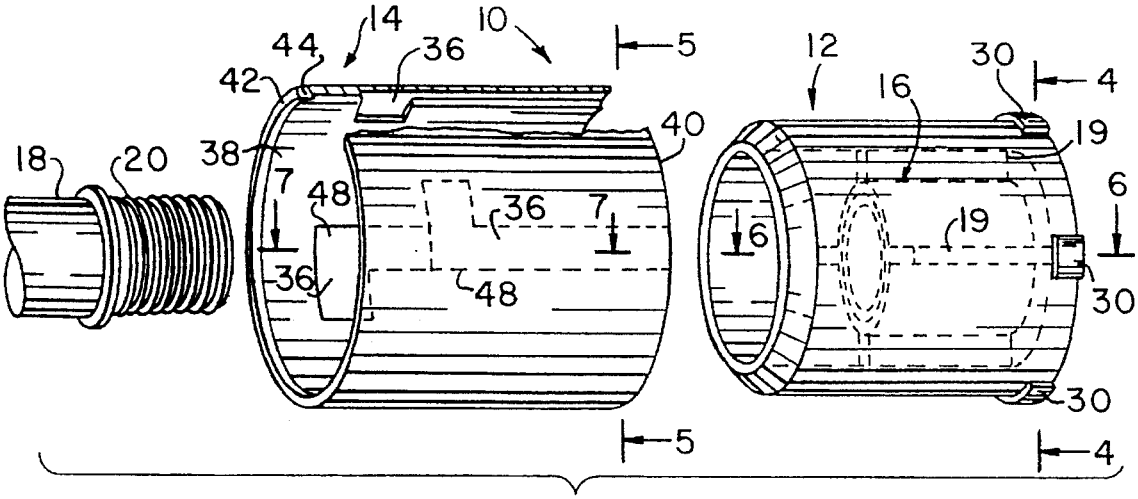
FIG. 1 is an exploded perspective view of the components according to a first embodiment of the present invention.

The present invention relates to a handle assembly for an object which is hand-held and hand-carried, such as an umbrella. The handle assembly can be used with a folding umbrella or a stick umbrella. The handle assembly is shown and described as a cylindrical handle, but may be used with a variety of handles including, for example, a Prince of Wales handle.

A first embodiment of the present invention is described in conjunction with FIGS. 1–7. Handle assembly 10 has a shaft adapter 12 which fits within a sleeve 14 which is coaxial with the adapter. Adapter 12 has a centrally located, threaded receptacle 16 which receives a threaded shaft 18, which has threads 20 at one end. Radial struts 19 are provided to support the receptacle. At the other end of the shaft is a body of a carried device, such as the frame and fabric (not shown) of an umbrella, as shown in the incorporated U.S. Pat. No. 5,186,197.

Adapter 12 has a generally cylindrical body with an open end 24 and a closed end 26. Adapter 12 receives the shaft 18 through open end 24. The open end has an annular rim with a constant inner diameter and an outer diameter which has a beveled portion 28 at an angle of about 15°. At closed end 26, four equally spaced radial tabs 30 are integrally molded at the outside diameter of the cylindrical adapter body.

Sleeve 14 is generally a cylindrical tube with four equally spaced L-shaped grooves 36 at interior surface 38. Grooves 36 axially extend from one end 40 of sleeve 14 to elbow 48 at a position before the other end 42 of sleeve 14. At end 42, sleeve 14 has a rim 44 which has an inner diameter which is slightly less than the inner diameter of the sleeve adjacent the rim.

The outer diameter of adapter 12 is slightly smaller than the inner diameter of sleeve 14 along the entire length of the adapter. This relationship applies both over the main body of adapter 12, as well as at the portion of greatest diameter, i.e., where there are two oppositely disposed radial tabs 30. The outer diameter at the tabs 30 has a length which is just slightly less than the inner diameter of the sleeve within grooves 36.

Figure 2:
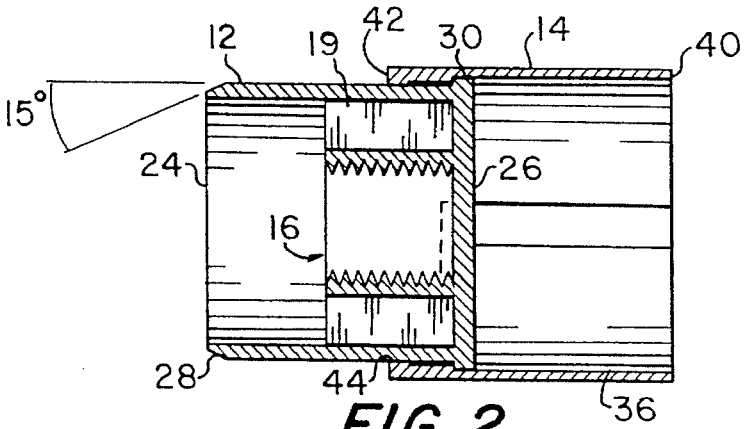
FIGS. 2 and are cross-sectional views of components of FIG. 1 in open and closed positions, respectively.
Figure 3:
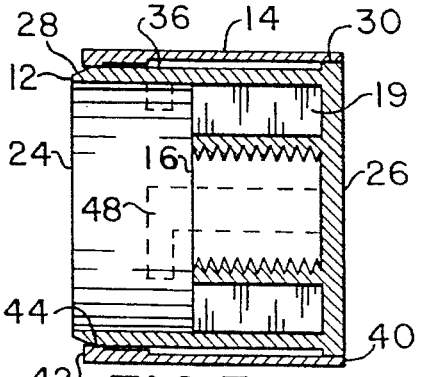
Figure 4:
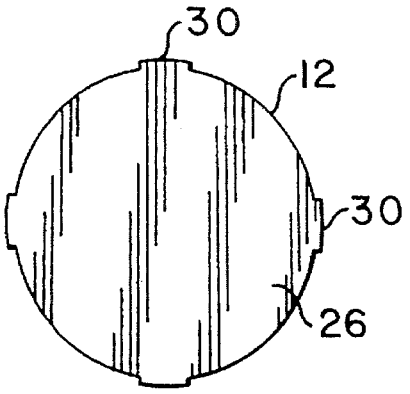
FIGS. 4 and 5 are end views taken at lines 4—4 and 5—5 of FIG. 1, FIGS. 6 and 7 cross-sectional views taken at lines 6—6 and 7—7 FIG. 1.
Figure 5:
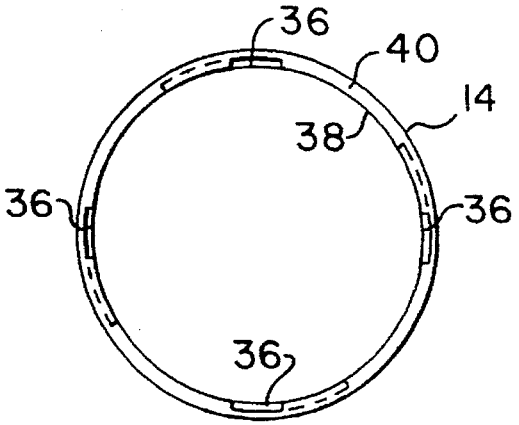
Figure 6:
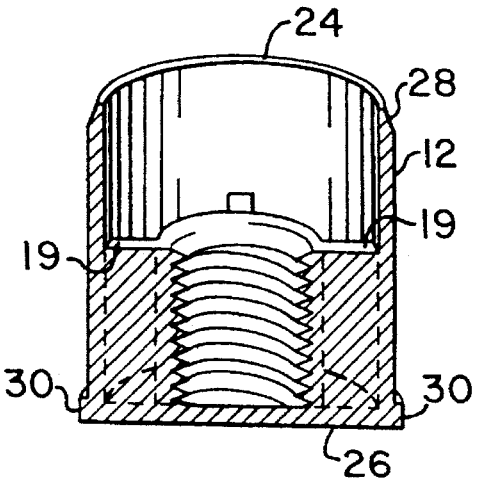
Figure 7:
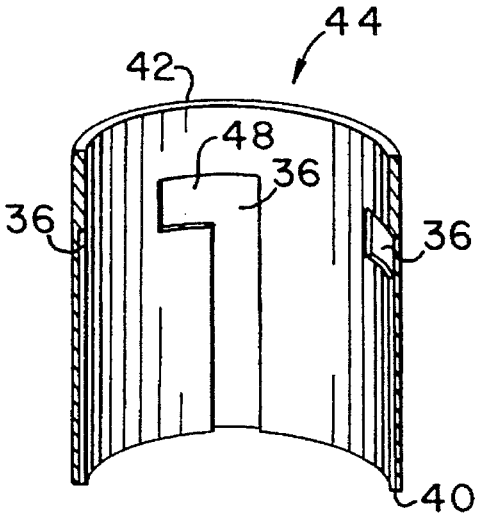

Referring to FIGS. 2 and 3, the sleeve and adapter are shown in open and closed positions, respectively. In the closed position, the combined axial length of the axial sleeve and the adapter is about the same as the length of the sleeve. In the open position, the combined axial length is increased by about the axial length of grooves 36. In the closed position, tabs 30 are at a base position of slots 36, while at the other end, rim 44 of the sleeve contacts beveled portion 28 of the adapter. A user may pull the adapter relative to the sleeve until the tabs are at elbows 48 of grooves 36. At this point, the adapter and shaft may also be moved circumferentially with respect to each other so that the tabs are axially locked within the L-shaped portions of grooves 36.

Adapter 12 and sleeve 14 may be sized to have a fairly tight fit. The frictional force should be sufficient so that the shaft and adapter cannot move easily relative to each other without user input, but not so great that it is difficult for a user to move the adapter relative to the sleeve. Thus, it is possible for a user to set the position of the adapter relative to the sleeve over a continuum of positions between the closed position (FIG. 3), and the fully open position (FIG. 2). Over a short term, the sleeve and adapter may stay in a set position intermediate the fully open and closed positions. When carried, however, if not in a fully open position, the sleeve and the adapter may have a tendency to move from the set position.

A cap (not shown) mates with end 40 of sleeve 14. When the handle is manufactured, adapter 12 is first inserted through end 40 of sleeve 14 so that tabs 30 mate with grooves 36. Next, the cap is bonded to end 40 of sleeve 14.

According to the present invention the grooves may have other shapes. For example, the grooves could simply be straight without an elbow. If the adapter 12 is mounted tightly within sleeve 14, they will not easily move inadvertently relative to each other even without the elbow. As another alternative, the groove could have multiple elbow portions so that a user could select one of several discrete positions between the closed position and the maximum open position. Grooves 36 may extend from about two-thirds to three-quarters of the length of sleeve 14. As a result, the overall length of the handle can be extended by about two-thirds. The grooves should not be so long that, when extended, the handle wiggles in a direction transverse to the shaft.

A second embodiment of the present invention is described in conjunction with FIGS. 8–11. Handle assembly 60 has an adapter 62 which has a threaded receptacle 63 for receiving coaxial shaft 18 with threaded end 20. Adapter 62 is generally similar to adapter in the first embodiment (FIGS. 1–7), except that in adapter 62, the closed end has an opening 70 at the base of receptacle 63. Adapter 62 is positioned within a coaxial inner sleeve 64, which in turn fits within a coaxial outer sleeve 66. A cap 68 is bonded to an end of outer sleeve 66. Adapter 62 and inner sleeve 64 each have four identical, equally-spaced tabs 72, 74, respectively. Inner sleeve 6& and outer sleeve 66 are each generally cylindrical tubes, each of which has four identical, equally spaced, axial grooves 76, 78, respectively. Adapter 62 has a beveled rim 80 which contacts ridge 82 of inner sleeve 64, similar to beveled portion 28 and ridge 44 in the first embodiment.

Adapter 62 fits fairly tightly within inner sleeve 64, which in turn fits fairly tightly within inner sleeve 66. As a result, the user may extend the handle by moving adapter 62 relative to inner sleeve 64; inner sleeve 64 with respect to outer sleeve 66 or both the adapter relative to the inner sleeve and the inner sleeve relative to the outer sleeve. In a fully extended position (FIG. 9) the handle has an effective length which about twice the length of the handle in a closed position.

Cap 68 has a curved end 90 with an outer diameter 86 which is about the same as the dimension of the outer diameter of outer sleeve 66. Cap 68 has a reduced diameter portion 88 adjacent the outer diameter of the cap. The reduced diameter portion has an outer diameter which is slightly smaller than the inner diameter of outer sleeve 66. A shoulder 92 between outer diameter 86 and reduced diameter portion 88 rests against end 94 of outer sleeve 66.

In this embodiment, adapter 62 could alternatively have a completely closed end similar to adapter 12 in the first embodiment. Grooves 76 and 78 could also be varied as desired to have one or more L-shaped portions to assist in locking the handle in place. Other shapes may also be possible for the grooves.

In an exemplary embodiment of the second embodiment, adapter 62, inner sleeve 64, and outer sleeve 66 have lengths in inches of 1.875, 1.875, and 2.0, respectively; inner diameters of 1.4, 1.52, and 1.64, respectively; and outer diameters of 1.52, 1.64, and 1.76, respectively, excluding the tabs. At the tabs, adapter 62 and inner sleeve 64 have outer diameters of 1.58 and 1.7 inches, respectively while the inner diameters of the inner sleeve and the outer sleeve are about 1.58 and 1.7 inches, respectively. Cap 68 has a reduced outer diameter portion of 1.64 inches, and an outer diameter of 1.76 inches. The cap extends the overall length of the handle in closed or open position by about 0.25 inches. Accordingly, in the closed position, handle assembly 60 has a length of about 2.25 inches, which is the sum of the length of the outer sleeve and the length added by the cap. When in a fully extended position (FIG. 9), handle assembly 60 has a length of about 4.375 inches, i.e. about twice the length in closed position. The adapter and sleeves preferably have a typical wall thickness of about 0.06 inches. It should be understood that these dimensions are illustrative, and may be varied as desired.

Figure 12:
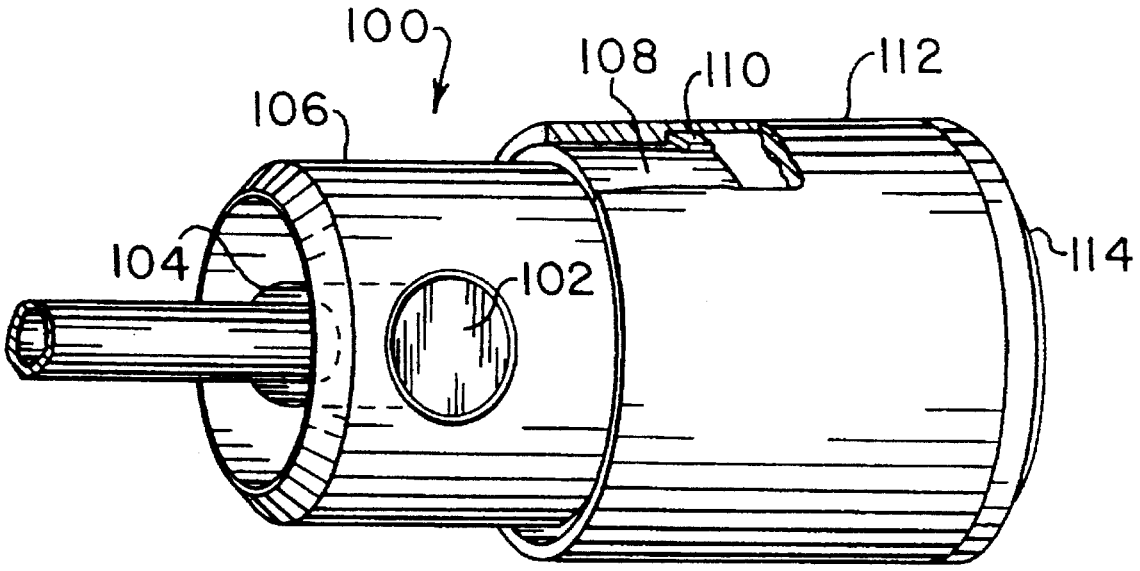
FIGS. 12 and 13 are partially cut away perspective views of a third embodiment of he present invention in open and closed positions, respectively.
Figure 13:
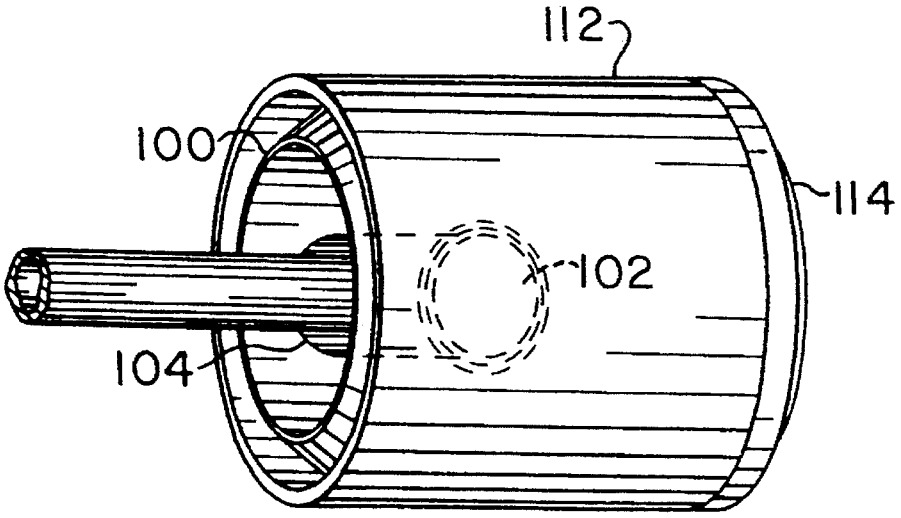

A third embodiment of the present invention is shown in partially cut away perspective views of FIGS. 12 and 13. According to this embodiment, an adapter 100 has a hand-operated switch 102, such as a push button, for engaging an opening mechanism 104 to cause a folded umbrella to extend. Such opening mechanisms are generally well known in the art of umbrella manufacture.

Figure 8:
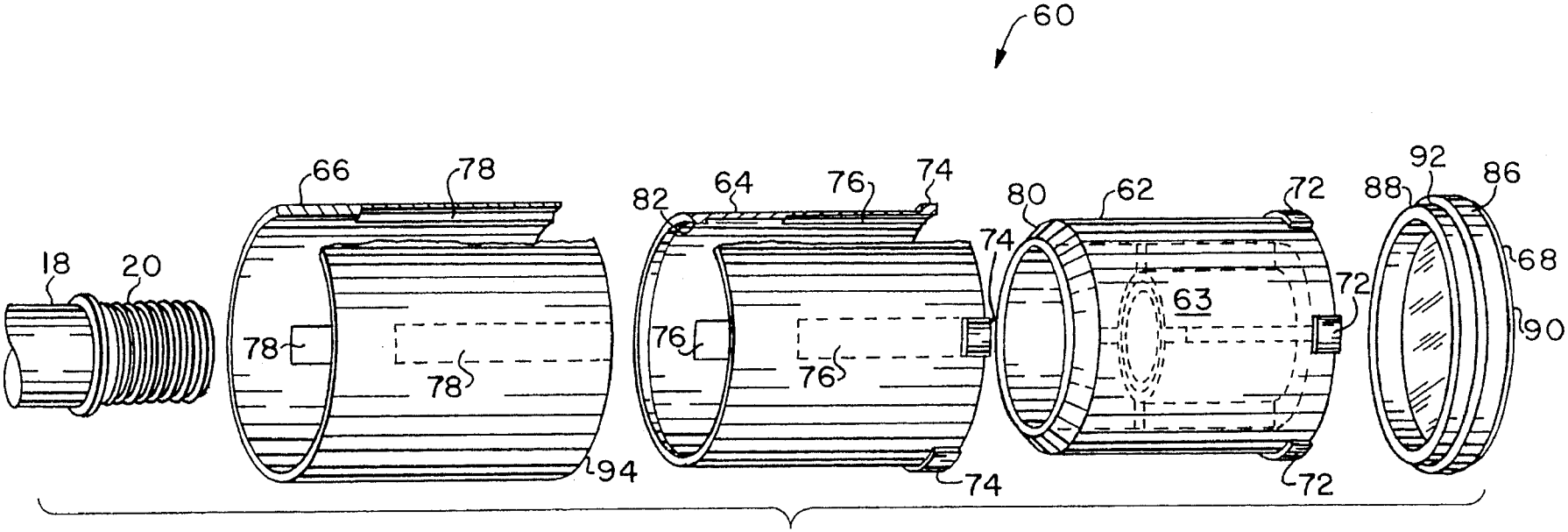
FIG. 8 is an exploded view according to a second embodiment of the present invention.
Figure 9:
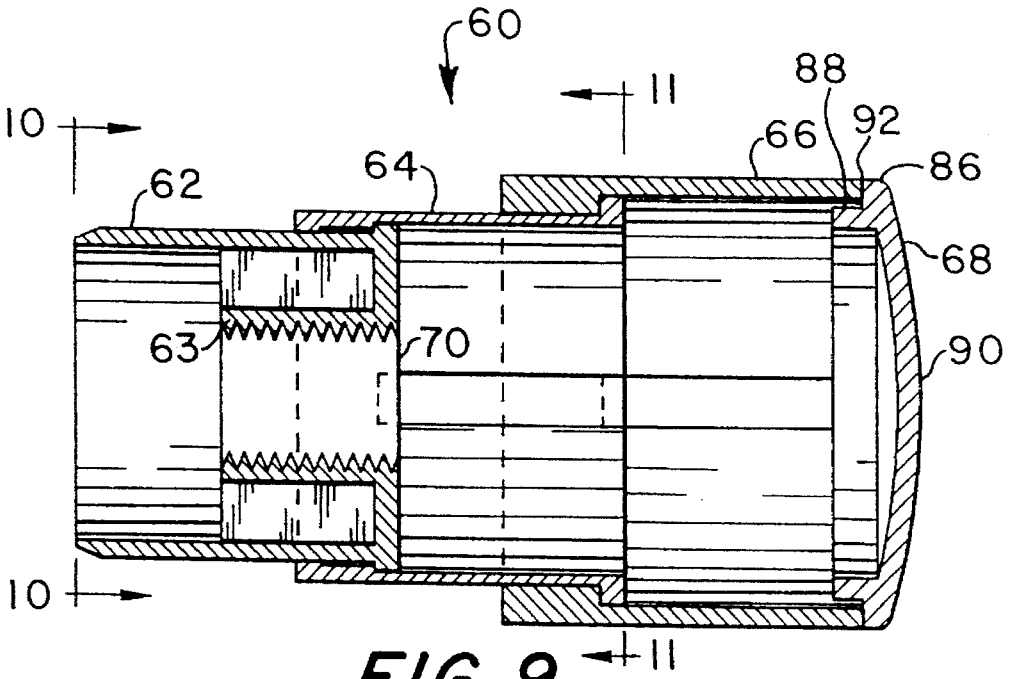
FIG. 9 is a cross-sectional view of the second embodiment in an open position.
Figure 10:
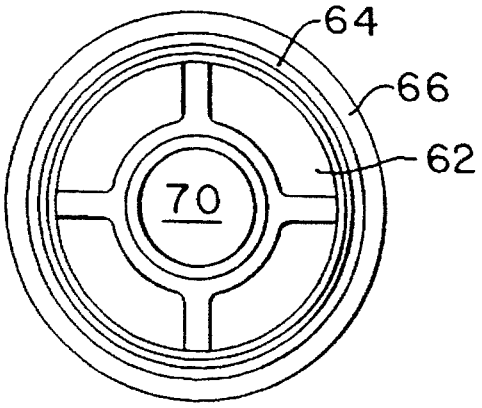
FIG. 10 is a cross sectional view taken along the line 10—10 in FIG. 9.
Figure 11:
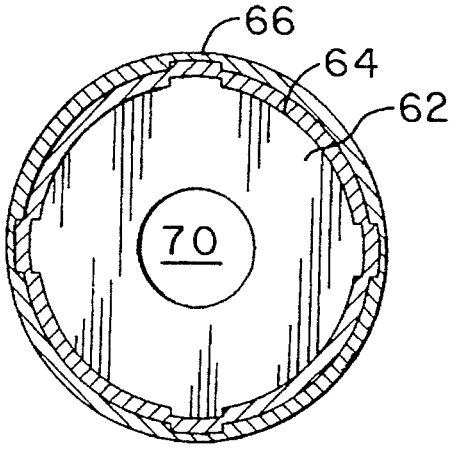
FIG. 11 is a cross-sectional view taken along the line 11—11 in FIG. 9.

The push button is on a main cylindrical body 106 of the adaptor. The adapter has an increased diameter portion 108 at one end of the main body. Increased diameter portion 108 has four integrally molded radially extending tabs 110 (only one is shown) similar to those in the first and second embodiments. A generally tubular outer sleeve 112 has four axial grooves (not shown) on an inside surface. Sleeve 112 may be very similar to outer sleeve 66 in the second embodiment (FIG. 8). A cap 114 which is similar to cap 68 (FIG. 8) is bonded over an end of sleeve 112.

In the closed position (FIG. 13), the sleeve fully covers the main body of the adapter and the increased diameter portion of the adaptor, including the push button. This arrangement helps prevent the umbrella from being inadvertently opened by pushing the push button since the button is now shielded by the sleeve. In the open position, the handle is extended by moving the sleeve relative to the adaptor, thus exposing the push button (FIG. 12). A user has extended the handle and can now actuate the opening mechanism.

In an exemplary embodiment, the sleeve is about 2.0 inches while the adaptor is about 1.9 inches in length. In the open position, the combined axial length of the sleeve and the adaptor is about 3.4 inches. The increased diameter portion has an axial length of about 0.5 inches. The increased diameter portion may be a ring which is retrofitted to an adapter, or the adapter may be integrally molded to have an increased diameter portion when it is manufactured.

In each embodiment, the adapter is preferably back end loaded. First, the sleeve is provided and the adapter is inserted through the end of the sleeve which faces away from the shaft. Next a cap is provided to the end of the sleeve to close off the sleeve. Thus where a tab and groove are used, the end of the groove limits movement in one direction and the cap serves as a stop to limit movement in the other direction. The cap need not necessarily be completely closed, but preferable has at least an annular portion to prevent the adapter from being pulled out of the sleeve through the capped end.

Other modifications can be made to the embodiments which are described and shown in the drawings without departing from the scope of the present invention as defined by the appended claims. For example, the shaft and adapter can be coupled to each other in any of a number of ways other than by threaded portions or by a push button switch located on the adapter.

Additional sleeves can be added to further extend the handle. As a result, there could be four or more components which move relative to each other. Some components can be rigidly coupled to each other while others move axially relative to each other.

The adapter could be the component with the greatest outer diameter, and the sleeve or sleeves could potentially fit within the adapter. In this case, the sleeve or sleeves could be pulled from the adapter with alterations in the design.

While the adapter and the sleeves have generally been shown as cylindrical or tubular, they could also have bodies which have one of a variety of cross-sectional configurations, such as a square, rectangle, or some other multi-sided or multi-curved configuration. Thus the term "inner diameter" and "outer diameter" are not limited to diameters for circular shapes, but can refer generally to a cross-section.

The tabs have been shown as being fairly small relative to the circumference, and four tabs have been shown in each embodiment. It should be understood that more or fewer tabs can be provided, and that they can have dimensions which are different from those shown, or one tab can have dimensions which are different from another tab. Also possible would be a single tab extending around part or all of the circumference of the adapter, and a groove which is effectively a reduced diameter region.

The adapter and sleeve can also be made extendible with a purely friction fit in which one of the sleeve and adapter is tapered relative to the other to limit movement in an axial direction. For example, if the adapter is tapered and the sleeve is cylindrical, the sleeve would be movable to a position where the adapter became sufficiently wide so that the sleeve would not extend further. Moreover, as an alternative to using tabs, a circumferential groove can be provided in the adapter, and the sleeve could be tapered or have a reduced diameter rim, as in the present invention, which mates with the circumferential groove to lock in an extended position.

What is claimed is:

1. An umbrella comprising:

an elongated shaft;

an adapter coupled to an end of the elongated shaft, the adapter having an opening for receiving the shaft; and a first sleeve coaxial with the adapter;

wherein one of the adapter and the first sleeve has a tab and the other of the adapter and the first sleeve has a groove which mates with the tab, wherein the first sleeve and the adapter are axially movable relative to each other from a first position to a second position, wherein the combined axial length of the adapter and first sleeve in the second position is longer than the combined axial length of the adapter and first sleeve in the first position.

2. The umbrella of claim 1 wherein the elongated shaft has a threaded end and the adapter has a threaded receptacle for coupling the adapter to the elongated shaft.

3. The umbrella of claim 1 wherein the adapter and the first sleeve have an interface with a tight frictional fit so that when the adapter and the first sleeve are at a relative position between the first and second positions, the relative position is maintained without user input, but can be axially altered along a continuum of positions with user input.

4. The umbrella of claim 1 wherein the adapter has a generally cylindrical portion, and the first sleeve is generally tubular, wherein the inner diameter of the first sleeve is about the same length as the outer diameter of the adapter.

5. The umbrella of claim 4 wherein the tab extends radially from the adapter, and wherein the groove is on an inner surface of the first sleeve.

6. The umbrella of claim 5 wherein the adapter has a plurality of substantially identical, equally spaced tabs arranged around the circumference of the adapter, and wherein the first sleeve has an equal plurality of grooves having axial portions equally spaced around the inner surface of the first sleeve.

7. The umbrella of claim 1 further comprising a second sleeve which is coaxial with the adapter and the first sleeve, wherein the second sleeve is axially movable relative to the first sleeve from a third position to a fourth position, wherein the combined axial length of the first sleeve and the second sleeve in the fourth position is greater than the combined axial length of the first sleeve and the second sleeve in the third position.

8. The umbrella of claim 7 wherein the first sleeve and the second sleeve have tubular portions, the adapter has a cylindrical portion, the outer diameter of the adapter has about the same dimension as the inner diameter of the first sleeve, and the outer diameter of the first sleeve has about the same dimension as the inner diameter of the second sleeve.

9. An umbrella comprising:

an elongated shaft having an axis; and a handle assembly including an adapter coupled to and coaxial with the shaft, the adapter having a main body with an outer wall having a cross-sectional configuration, and a hollow sleeve having an inner wall with a cross-sectional configuration which is substantially the same as the cross-sectional configuration of the outer wall of the adapter, wherein the sleeve is axially movable from a first position, in which the sleeve surrounds the adapter over at least a portion of the length of the adapter so that the combined axial length of the adapter and the sleeve is about the same as the axial length of the sleeve, to a second position in which the sleeve surrounds a portion of the adapter, the rest of the adapter being an exposed portion, wherein the combined axial length of the sleeve and the adapter is about equal to the combined axial length of the sleeve and the exposed portion of the adapter.

10. A telescopic handle assembly for an umbrella comprising:

an adapter having a mechanism for opening the umbrella, and a switch for operating the mechanism a first sleeve coupled to the adapter and movable from a first position to a second position, wherein in the first position, the first sleeve and the adapter have a first combined axial length, and wherein the first sleeve shields the switch, and wherein in the second position, the adapter and the first sleeve have a combined axial length which is greater than the first combined axial length, and wherein the switch is exposed for manual actuation.

11. The assembly of claim 10 wherein one of the adapter and first sleeve has a radially extending tab, and the other of the adapter and the first sleeve has a groove which mates with the tab.

12. The assembly of claim 11 wherein the adapter has a plurality of equally spaced radial tabs, and wherein the first sleeve is generally tubular and has an equal plurality of axially extending groove.

13. The assembly of claim 10 further comprising a second sleeve coupled to the first sleeve, the second sleeve being axially movable relative to the first sleeve from a third position to a fourth positions, wherein the combined axial length of the first sleeve and the second sleeve is greater in the fourth position than in the third position.

14. A handle assembly for a hand-held, hand-carried device comprising:

an adapter having a threaded receptacle having a first diameter and an outer body having an opening having a second diameter, wherein the second diameter is greater than the first diameter; and a sleeve enclosing at least part of the adapter, wherein the sleeve is movable from a first position to a second position, wherein in the first position, the sleeve and the adapter have a first combined axial length, and wherein in the second position, the combined axial length of the adapter and the first sleeve is greater than the first combined axial length.

15. An umbrella comprising:

an elongated shaft; and a handle assembly including an adapter coupled to an end of the elongated shaft, and a first sleeve which is coaxial with the adapter, wherein the first sleeve and the adapter are axially movable relative to each other from a first position to a second position, wherein the combined axial length of the adapter and first sleeve in the second position is longer than the combined axial length of the adapter and first sleeve in the first position.

16. The umbrella of claim 15, further comprising a shell coaxial with the shaft and telescopically coupled to the sleeve, wherein the shell is axially movable from a first position to a second position to axially increase a combined length of the sleeve and the shell.

17. An umbrella comprising:

an elongated shaft with an axis; and a handle assembly including:

an adapter for coupling to the shaft, the adapter having a mechanism for opening the umbrella, and a switch for operating the mechanism;

a first sleeve coupled to the adapter and movable from a first position to a second position, wherein in the first position, the first sleeve and the adapter have a first combined axial length, wherein in the second position, the adapter and the first sleeve have a combined axial length which is greater than the first combined axial length, and wherein the switch is exposed for manual actuation in the second position.

18. The umbrella of claim 17, wherein the switch includes a push button.

19. The umbrella of claim 17, wherein one of the adapter and the first sleeve has a tab and the other of the adapter and the first sleeve has a groove which mates with the tab.

20. The umbrella of claim 17, wherein first sleeve shield the switch when in the first position.

* * * * *